US009181005B2

(12) United States Patent
DeMarco

(10) Patent No.: US 9,181,005 B2
(45) Date of Patent: Nov. 10, 2015

(54) CONTAINER CAPS AND SYSTEMS

(75) Inventor: Jenny DeMarco, Plano, TX (US)

(73) Assignee: Mary Kay Inc., Addison, TX (US)

( * ) Notice: Subject to any disclaimer, the term of this patent is extended or adjusted under 35 U.S.C. 154(b) by 563 days.

(21) Appl. No.: 12/358,408

(22) Filed: Jan. 23, 2009

(65) Prior Publication Data

US 2010/0018975 A1 Jan. 28, 2010

Related U.S. Application Data

(60) Provisional application No. 61/083,365, filed on Jul. 24, 2008.

(51) Int. Cl.
*B65D 43/18* (2006.01)
*B65D 47/26* (2006.01)

(52) U.S. Cl.
CPC ..... *B65D 47/265* (2013.01)

(58) Field of Classification Search
CPC ..... B65D 47/265
USPC ..... 220/253, 254.1, 373, 374, 254.4, 821; 222/548, 557
See application file for complete search history.

(56) References Cited

U.S. PATENT DOCUMENTS

| | | | | | |
|---|---|---|---|---|---|
| 1,891,031 | A | * | 12/1932 | Van Arsdale | 222/545 |
| 2,381,207 | A | * | 8/1945 | Coleman | 215/206 |
| 2,961,228 | A | * | 11/1960 | Moore | 432/262 |
| 3,029,003 | A | * | 4/1962 | Gronemeyer | 222/545 |
| 3,042,273 | A | | 7/1962 | Bauer et al. | 222/548 |
| 3,094,283 | A | * | 6/1963 | Balister | 239/393 |
| 3,149,755 | A | * | 9/1964 | Porter et al. | 222/83 |
| 3,204,836 | A | * | 9/1965 | Joffe | 222/545 |
| 3,214,069 | A | | 10/1965 | Dike | 222/498 |
| 3,388,841 | A | | 6/1968 | McHardy | 222/548 |
| 3,419,198 | A | | 12/1968 | Petterson | 222/541.2 |
| 3,429,481 | A | | 2/1969 | Navia | 222/83 |
| 3,467,287 | A | | 9/1969 | Marchant et al. | 222/480 |
| 3,860,111 | A | * | 1/1975 | Thompson | 206/534 |
| 3,889,852 | A | | 6/1975 | Strefford | 43/112 |
| 3,991,908 | A | * | 11/1976 | Thomas et al. | 221/154 |
| D247,848 | S | | 5/1978 | Croyle | D9/447 |
| 4,179,051 | A | * | 12/1979 | Thomas | 222/494 |
| 4,183,443 | A | * | 1/1980 | DeParales et al. | 220/714 |
| 4,220,248 | A | | 9/1980 | Wilson et al. | 215/235 |
| 4,261,486 | A | | 4/1981 | Bush et al. | 222/517 |
| 4,299,339 | A | | 11/1981 | Giroux et al. | 222/153.14 |

(Continued)

FOREIGN PATENT DOCUMENTS

| | | |
|---|---|---|
| CH | 598 066 A5 | 2/1952 |
| CH | 280 997 A | 4/1978 |

(Continued)

OTHER PUBLICATIONS

Machine translation of CH280997.*

(Continued)

*Primary Examiner* — Fenn Mathew
*Assistant Examiner* — James N Smalley
(74) *Attorney, Agent, or Firm* — Norton Rose Fulbright US LLP

(57) ABSTRACT

Caps and container systems suited to dispensing products like cosmetics. Some of the caps include three portions that can be coupled together and that include a dispensing system that has an open position and a closed position.

20 Claims, 7 Drawing Sheets

(56) References Cited

U.S. PATENT DOCUMENTS

D263,805 S 4/1982 Seager ..... D9/450
4,346,823 A * 8/1982 Eppenbach ..... 222/443
4,358,032 A 11/1982 Libit ..... 222/498
4,377,247 A 3/1983 Hazard et al. ..... 222/517
4,380,307 A 4/1983 Stillinger ..... 222/142.9
4,432,760 A * 2/1984 Mittleman et al. ..... 604/246
4,457,458 A 7/1984 Heinol ..... 222/498
D275,655 S 9/1984 Bainton ..... D9/438
4,500,016 A * 2/1985 Funfstuck ..... 222/153.14
4,519,517 A 5/1985 Walter ..... 215/253
4,538,653 A 9/1985 Shea et al. ..... 141/285
4,570,817 A 2/1986 Hambleton et al. ..... 220/345.2
4,598,837 A 7/1986 Kreiseder et al. ..... 220/253
4,613,063 A 9/1986 Wright ..... 222/153.14
4,625,898 A 12/1986 Hazard ..... 222/517
4,653,672 A 3/1987 Tuerk et al. ..... 222/153.14
4,666,068 A 5/1987 Bush ..... 222/546
D291,536 S 8/1987 Crawford et al. ..... D9/440
4,699,299 A 10/1987 Gach ..... 222/480
4,793,502 A 12/1988 Beck ..... 215/235
4,807,768 A 2/1989 Gach ..... 215/216
4,826,026 A 5/1989 Gach et al. ..... 215/206
4,852,770 A 8/1989 Sledge et al. ..... 222/153.14
4,856,995 A * 8/1989 Wagner ..... 433/215
D306,701 S 3/1990 Beck ..... D9/446
4,993,606 A 2/1991 Bolen et al. ..... 222/546
D315,308 S 3/1991 Van Kerkhoven ..... D9/450
D315,872 S 4/1991 Bixler ..... D9/446
5,005,737 A 4/1991 Rohr ..... 222/212
5,007,555 A 4/1991 Beck ..... 220/254.3
5,040,694 A 8/1991 Gambello ..... 220/255
D320,746 S 10/1991 Bolen et al. ..... D9/446
5,058,778 A 10/1991 Weinstein ..... 222/209
5,062,542 A 11/1991 Morton ..... 220/269
5,065,911 A 11/1991 Rohr et al. ..... 222/517
5,105,959 A 4/1992 Kinsley ..... 215/227
5,123,574 A * 6/1992 Poulos ..... 222/362
D328,710 S 8/1992 Deflander ..... D9/529
D328,711 S 8/1992 Deflander ..... D9/524
5,161,718 A * 11/1992 Gueret ..... 222/212
D334,538 S 4/1993 Bolen et al. ..... D9/447
D334,709 S 4/1993 Fleming et al. ..... D9/449
5,199,617 A 4/1993 Bennet ..... 222/498
5,211,300 A 5/1993 Hsing et al. ..... 215/11.4
5,213,235 A 5/1993 Miranda ..... 222/107
5,213,238 A 5/1993 Martin et al. ..... 222/480
D336,430 S 6/1993 Maguire et al. ..... D9/448
5,242,075 A 9/1993 Ott et al. ..... 220/361
D340,188 S 10/1993 Forsyth ..... D9/449
D341,225 S 11/1993 Lang et al. ..... D28/76
5,289,945 A * 3/1994 Stradder ..... 222/23
5,325,999 A * 7/1994 Gueret ..... 222/212
D349,647 S 8/1994 Moffit ..... D9/435
5,356,017 A 10/1994 Rohr et al. ..... 215/216
5,358,130 A 10/1994 Mengeu et al. ..... 215/238
5,358,132 A * 10/1994 Bennett ..... 220/253
5,358,146 A * 10/1994 Stull ..... 222/148
D352,457 S 11/1994 Hughes et al. ..... D9/447
5,361,920 A 11/1994 Nozawa et al. ..... 215/237
5,366,115 A 11/1994 Kersten et al. ..... 222/105
5,379,926 A 1/1995 Mueller et al. ..... 222/507
D357,200 S 4/1995 Thomas ..... D10/103
5,419,446 A * 5/1995 Cox et al. ..... 215/21
D359,905 S 7/1995 Molo ..... D9/447
5,437,383 A 8/1995 Stull ..... 215/235
5,489,035 A 2/1996 Fuchs ..... 215/235
5,507,419 A 4/1996 Martin et al. ..... 222/480
5,520,307 A 5/1996 Miller et al. ..... 221/2
5,533,649 A 7/1996 Von Schuckmann .... 222/153.14
D374,399 S 10/1996 Neveras et al. ..... D9/447
5,566,850 A 10/1996 Forsyth et al. ..... 220/253
5,601,213 A 2/1997 Daniello ..... 222/456
5,620,114 A * 4/1997 Chalfa, Jr. ..... 222/23
D385,791 S 11/1997 Forsyth et al. ..... D9/447
D389,761 S 1/1998 Thomas ..... D10/103
5,730,322 A * 3/1998 Iba et al. ..... 222/42
5,738,236 A 4/1998 Brun, Jr. ..... 220/253
5,785,213 A * 7/1998 Guillot ..... 222/553
D407,976 S 4/1999 Ekkert ..... D9/449
5,913,435 A 6/1999 Fuchs ..... 215/237
5,927,556 A 7/1999 Mooney et al. ..... 222/153.14
5,960,972 A 10/1999 Larguia ..... 215/274
5,975,354 A 11/1999 Goncalves ..... 222/39
D418,363 S 1/2000 Barnes et al. ..... D7/392
6,089,411 A 7/2000 Baudin et al. ..... 222/212
D443,518 S 6/2001 Goettner ..... D9/530
6,241,128 B1 6/2001 McClean et al. ..... 222/212
6,244,470 B1 6/2001 Harley-Wilmot ..... 222/153.14
D444,387 S 7/2001 Adachi et al. ..... D9/529
6,283,339 B1 9/2001 Morrow ..... 222/452
6,302,301 B1 10/2001 Vette ..... 222/142.6
6,315,170 B1 11/2001 Thomson et al. ..... 222/361
6,332,551 B1 12/2001 Copeland ..... 220/262
6,336,460 B2 1/2002 Yuhara ..... 132/295
6,378,735 B1 * 4/2002 Chu ..... 222/158
6,382,476 B1 5/2002 Randall et al. ..... 222/545
6,394,323 B2 5/2002 McClean et al. ..... 222/534
6,405,867 B1 6/2002 Moore ..... 206/459.1
6,405,885 B1 6/2002 Elliot ..... 215/237
6,419,825 B1 7/2002 Hahmann et al. ..... 210/232
6,439,442 B1 8/2002 Markert et al. ..... 222/547
D468,639 S 1/2003 Wennerstrom et al. ..... D9/449
D470,765 S 2/2003 Baker ..... D9/420
6,543,650 B1 4/2003 Sprick et al. ..... 222/153.14
6,564,978 B1 5/2003 Safian et al. ..... 222/534
D475,618 S 6/2003 Barnes et al. ..... D9/414
D476,559 S 7/2003 Norris et al. ..... D9/442
D477,532 S 7/2003 Wong ..... D9/449
D479,803 S 9/2003 Alguire et al. ..... D9/523
6,615,473 B2 9/2003 McClean et al. ..... 29/434
6,622,895 B2 9/2003 McClean et al. ..... 222/570
RE38,328 E * 11/2003 Gueret ..... 222/144.5
D485,181 S 1/2004 Yourist ..... D9/454
6,691,394 B1 2/2004 McClean ..... 29/434
6,698,590 B2 3/2004 Moore ..... 206/459.1
6,702,161 B2 3/2004 Adams et al. ..... 222/521
D488,383 S 4/2004 Kudo et al. ..... D9/522
6,757,957 B2 * 7/2004 McClean et al. ..... 29/453
6,766,926 B1 7/2004 Elchert ..... 222/498
D494,468 S 8/2004 Vovan ..... D9/435
6,783,031 B2 8/2004 Robbins et al. ..... 222/111
D497,802 S 11/2004 Haggerty et al. ..... D9/417
6,854,619 B2 2/2005 Knickerbocker ..... 222/1
D508,402 S 8/2005 Hierzer et al. ..... D9/449
D508,411 S 8/2005 Lamb et al. ..... D9/689
D509,137 S 9/2005 Hierzer et al. ..... D9/447
D509,138 S 9/2005 Hierzer et al. ..... D9/447
D509,428 S 9/2005 Hierzer et al. ..... D9/447
D509,429 S 9/2005 Hierzer et al. ..... D9/447
D509,430 S 9/2005 Hierzer et al. ..... D9/447
D509,431 S 9/2005 Hierzer et al. ..... D9/447
D509,432 S 9/2005 Hierzer et al. ..... D9/447
D509,735 S 9/2005 Hierzer et al. ..... D9/447
D509,736 S 9/2005 Hierzer et al. ..... D9/447
D509,737 S 9/2005 Hierzer et al. ..... D9/447
6,948,641 B1 * 9/2005 Williams ..... 222/456
6,966,468 B2 * 11/2005 McKay et al. ..... 222/486
D512,635 S 12/2005 Hierzer et al. ..... D9/447
6,971,547 B2 12/2005 Englert et al. ..... 222/1
6,988,642 B2 1/2006 Gallo et al. ..... 222/506
D515,917 S 2/2006 Hierzer et al. ..... D9/447
D515,918 S 2/2006 Hierzer et al. ..... D9/447
D515,919 S 2/2006 Hierzer et al. ..... D9/447
D516,910 S 3/2006 Bresler ..... D9/447
D518,712 S 4/2006 Hierzer et al. ..... D9/447
D518,713 S 4/2006 Hierzer et al. ..... D9/447
D518,714 S 4/2006 Hierzer et al. ..... D9/447
D518,715 S 4/2006 Hierzer et al. ..... D9/447
D529,800 S 10/2006 Liebe ..... D9/449
D530,202 S 10/2006 Herald et al. ..... D9/449
7,128,227 B2 10/2006 Skillin et al. ..... 215/235
D533,063 S 12/2006 Lee et al. ..... D9/449
D533,074 S 12/2006 Mongeon et al. ..... D9/687
D535,564 S 1/2007 Toth et al. ..... D9/522

(56) References Cited

U.S. PATENT DOCUMENTS

| | | | | |
|---|---|---|---|---|
| D538,161 | S | 3/2007 | Smith et al. | D9/449 |
| 7,201,288 | B2 | 4/2007 | Von Ronn et al. | 220/253 |
| 7,225,938 | B2 * | 6/2007 | Frisch | 215/11.4 |
| D548,086 | S | 8/2007 | Conway et al. | D9/732 |
| 7,331,478 | B2 * | 2/2008 | Aljadi | 215/11.4 |
| 7,374,053 | B2 | 5/2008 | Herald et al. | 215/237 |
| 7,475,833 | B2 * | 1/2009 | Chih | 239/394 |
| 7,513,399 | B2 * | 4/2009 | Mengeu | 222/575 |
| D604,160 | S * | 11/2009 | DeMarco | D9/449 |
| 7,648,037 | B2 * | 1/2010 | Ohashi | 215/313 |
| 7,651,003 | B2 * | 1/2010 | Albers et al. | 215/311 |
| 7,766,197 | B2 * | 8/2010 | Getsy | 222/480 |
| 1,124,523 | A1 | 1/2015 | Reeser | 222/480 |
| 2003/0042331 | A1 | 3/2003 | Lu | 239/436 |
| 2005/0082290 | A1 | 4/2005 | Fask et al. | 220/254.1 |
| 2005/0205607 | A1 | 9/2005 | Hierzer et al. | 222/153.1 |
| 2006/0011573 | A1 | 1/2006 | Herald et al. | 215/237 |
| 2006/0037886 | A1 | 2/2006 | Thiebaut | 206/581 |
| 2006/0043092 | A1 * | 3/2006 | Alfonso | 220/254.4 |
| 2006/0237388 | A1 | 10/2006 | Kick | 215/235 |
| 2006/0249473 | A1 | 11/2006 | Kunz | 215/235 |
| 2007/0187406 | A1 | 8/2007 | Nobile et al. | 220/254.4 |
| 2007/0199962 | A1 | 8/2007 | Mengeu | 222/575 |
| 2009/0236305 | A1 * | 9/2009 | DeMarco et al. | 215/316 |
| 2010/0018975 | A1 * | 1/2010 | DeMarco | 220/253 |

FOREIGN PATENT DOCUMENTS

| | | |
|---|---|---|
| CN | 12660077 | 9/2000 |
| EP | 1 022 229 | 7/2000 |
| JP | D1113385 | 3/2001 |
| JP | D1155998 | 10/2002 |
| TW | 281588 | 3/1984 |
| TW | D101297 | 10/1992 |

OTHER PUBLICATIONS

Search Report issued in Taiwan Application No. 097304400, dated Mar. 30, 2009.

International Search Report and Written Opinion, issued in Int. App. No. PCT/US2009/031805, mailed Mar. 10, 2009.

PCT International Preliminary Report on Patentability, issued in International application No. PCT/US2009/03185, dated Oct. 22, 2010.

Office Communication, issued in Chinese patent application No. 200980000033.3, dated Nov. 16, 2011. (English translation).

Notice of Allowance, issued in U.S. Appl. No. 12/407,391, mailed on May 25, 2012.

Office Communication, issued in Canadian Patent Application No. 2,731,825, mailed on Mar. 28, 2012.

Office Communication, issued in European Patent Application No. 009 700 025.1, mailed on Feb. 23, 2012.

Office Communication, issued in U.S. Appl. No. 12/407,391, mailed on Feb. 2, 2012.

* cited by examiner

CONTAINER CAPS AND SYSTEMS

This application claims priority to U.S. Provisional Application No. 61/083,365 filed on Jul. 24, 2008, the entire disclosures of which are specifically incorporated herein by reference in their entirety without disclaimer.

BACKGROUND OF THE INVENTION

1. Field of the Invention

The present invention relates generally to containers, and, more particularly, to container caps and systems.

2. Description of Related Art

Products are typically stored within containers. For example, cosmetic and food products are often stored in bottles and the like. A container may have a cap or lid that allows a consumer to have access to the product in a controlled fashion. When the cap is in an open position, the product is dispensed typically under an externally applied pressure and/or due to the force of gravity. When the cap is in a closed position, the product is stopped from leaving the container.

SUMMARY OF THE INVENTION

The present disclosure provides container caps and systems. Some embodiments of the present caps contain a bottom piece having a bottom piece top surface that includes an off-centered delivery opening, and a top piece rotatably coupled to the bottom piece. The top piece may have a top piece bottom surface that includes a dispensing opening and a detent element. The top piece may be coupled to the bottom piece such that the top piece bottom surface is adjacent to the bottom piece top surface, the dispensing opening is substantially aligned with the off-centered delivery opening when the cap is in an open position, and the detent element is substantially aligned with the off-centered delivery opening when the cap is in a closed position.

Some embodiments of the present caps contain a bottom assembly and a top piece. In some embodiments, the bottom assembly includes a lower piece having a lower piece top surface that includes a centered delivery opening, and a middle piece coupled to the lower piece. The middle piece may include a middle piece bottom surface, a middle piece top surface, and an off-centered delivery opening through the middle piece bottom surface and through the middle piece top surface. In some embodiments, the middle piece bottom surface is adjacent to the lower piece top surface. In some embodiments, the top piece has a top piece bottom surface that includes a dispensing opening and a detent element. The top piece may be rotatably coupled to the bottom assembly such that the top piece bottom surface is adjacent to the middle piece top surface, and the dispensing opening is substantially aligned with the off-centered delivery opening when the cap is in an open position, and the detent element is substantially aligned with the off-centered delivery opening when the cap is in a closed position.

In some embodiments, the middle piece may include a middle piece recessed region that is in the middle piece bottom surface and coupled to the off-centered delivery opening. A portion of the middle piece recessed region may be substantially aligned with the centered delivery opening.

In some embodiments, the lower piece top surface may include a lower piece recessed region coupled to the centered delivery opening. The off-centered delivery opening may be substantially aligned with a portion of the lower piece recessed region.

In some embodiments of the present caps, the bottom piece or the middle piece includes a raised lip that extends from the middle piece top surface and borders the off-centered delivery opening. The raised lip may be configured to contact an edge of the dispensing opening when the cap is in an open position.

In some embodiments, the dispensing opening and the detent element are separated by approximately 90 degrees with respect to a center of the top piece bottom surface. In other embodiments, In other embodiments, the dispensing opening and the detent element may be disposed to be separated by other angles with respect to a center of the top piece bottom surface, such as, for example, 30, 45, 60, 75, 105, 120, 135, 150, 165, or 180 degrees.

In some embodiments of the present caps, the bottom piece or the bottom assembly is configured to be coupled to a container. This coupling may be accomplished by any suitable manner, including, for example, a threaded engagement or a snap-fit engagement.

In some embodiments, the bottom piece or bottom assembly and the top piece are configured with mating rail elements that facilitate their rotation relative to each other. In some embodiments, this rotation may be limited by features on the bottom piece (or bottom assembly) and/or the top piece.

In some embodiments of the present caps, the bottom piece or the bottom assembly and the top piece are configured to direct a fluid through a path that includes the centered delivery opening, a channel formed by the lower piece recessed region and the middle piece recessed region, the off-centered delivery opening, and the dispensing opening. In some embodiments, the fluid path includes the centered delivery opening, the middle piece recessed region, the off-centered delivery opening, and the dispensing opening. In some embodiments, the fluid path includes the centered delivery opening, the lower piece recessed region, the off-centered delivery opening, and the dispensing opening.

Some embodiments of the present container systems include a bottle configured to hold a product, and a cap coupled to the bottle. The cap may include a dispensing system that includes a bottom piece coupled to a top piece. Other embodiments of the cap may include a top piece coupled to a bottom assembly, which has a lower piece and a middle piece. In these embodiments, the bottle may be any type of bottle, bin, can, chamber, flask, jar, jug, receptacle, repository, tube, vessel, vial, or the like.

Any embodiment of any of the present container systems and caps may consist of or consist essentially of—rather than comprise/include/contain/have—the described elements and/or features. Thus, in any of the claims, the term "consisting of" or "consisting essentially of" may be substituted for any of the open-ended linking verbs recited above, in order to change the scope of a given claim from what it would otherwise be using the open-ended linking verb.

Details associated with the embodiments described above and others are presented below. Other embodiments of the present caps and container systems are possible.

BRIEF DESCRIPTION OF THE DRAWINGS

The following drawings illustrate by way of example and not limitation. Every feature of a given structure is not always labeled in every figure in which that structure appears, in order to keep the figures clear.

DESCRIPTION OF ILLUSTRATIVE EMBODIMENTS

The term "coupled" is defined as connected, although not necessarily directly, and not necessarily mechanically. The terms "a" and "an" are defined as one or more unless this disclosure explicitly requires otherwise. The terms "substantially," "approximately," "about," and variations thereof are defined as being largely but not necessarily wholly what is specified, as understood by a person of ordinary skill in the art. In one non-limiting embodiment, the term substantially refers to ranges within 10%, preferably within 5%, more preferably within 1%, and most preferably within 0.5% of what is specified.

The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a cap or container system that "comprises," "has," "includes" or "contains" one or more elements possesses those one or more elements, but is not limited to possessing only those one or more elements. Likewise, an element of a cap that "comprises," "has," "includes" or "contains" one or more features possesses those one or more features, but is not limited to possessing only those one or more features. For example, a cap that includes a top piece and a bottom piece that includes a centered opening, a first recessed holding element coupled to the centered opening through a first recessed region, a second recessed holding element coupled to the centered opening through a second recessed region, and a raised element coupled to the centered opening is a cap with a bottom piece that includes the specified features but is not limited to having only those features. Such a bottom piece could also include, for example, a second raised element.

Furthermore, a device or structure that is configured in a certain way is configured in at least that way, but it may also be configured in ways other than those specifically described.

Figure 1A:
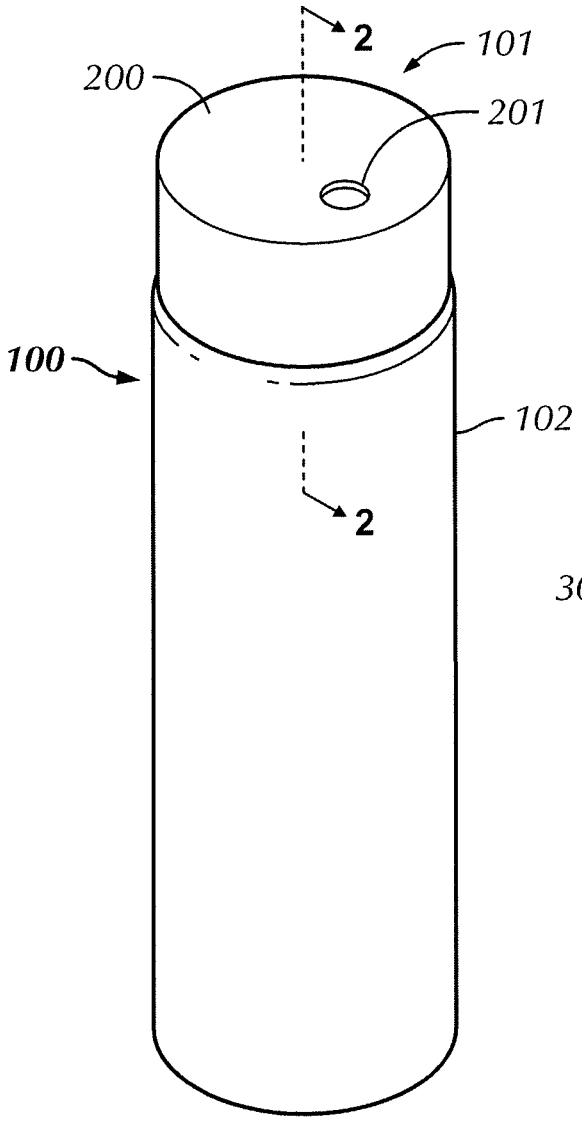
FIGS. 1A and 1B depict perspective and exploded perspective views of one of the present container systems that includes one of the present caps.
Figure 1B:
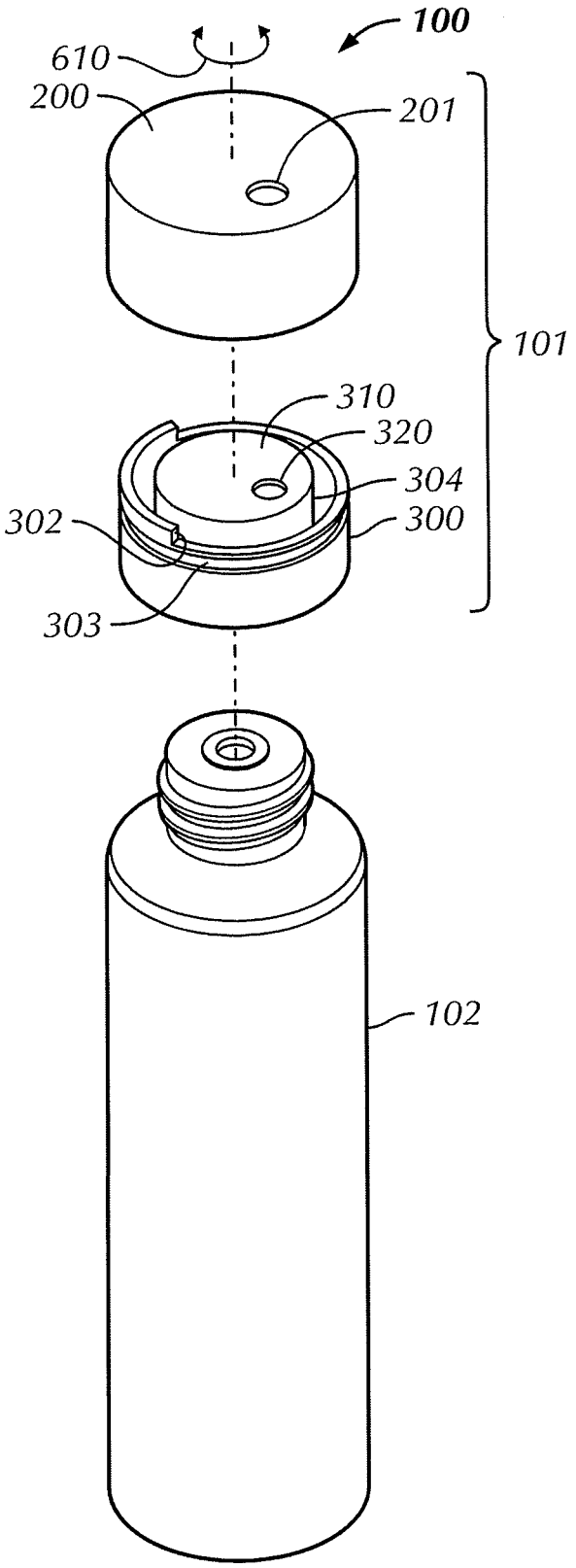

FIGS. 1A and 1B depict container system 100. System 100 comprises cap 101 operatively coupled to bottle 102. Bottle 102 may be any type of bottle, bin, can, chamber, flask, jar, jug, receptacle, repository, tube, vessel, vial, or the like. A product such as, for example, a cosmetic, pharmaceutical, or food product (not shown) may be stored within bottle 102. Cap 101 allows a consumer to have access to the product in a controlled manner. Particularly, when system 100 is in an open position, the product may be dispensed, for instance, under an externally applied pressure, the force of gravity, or both. When system 100 is in a closed position, the product is prevented from leaving system 100. Although bottle 102 is shown as having a cylindrical shape, it may have any shape.

Cap 101 may allow a user to operate system 100 by rotating cap 101 between the open position and the closed position by rotating (e.g., twisting) top piece 200, as depicted by arrow 610. In some embodiments, the allowable rotation of top piece 200 may be limited to a 90 degree range of motion. In other embodiments, the allowable range of motion may be unlimited, or may be limited to any other angular range, such as, for example, 30, 45, 60, 75, 105, 120, 135, 150, 165, or 180 degrees.

Figure 2:
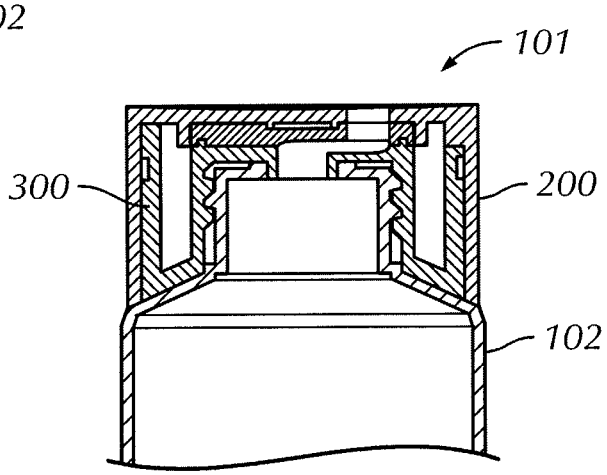
FIG. 2 is a cross-sectional view taken along lines 2-2 shown in FIG. 1A.
Figure 3:
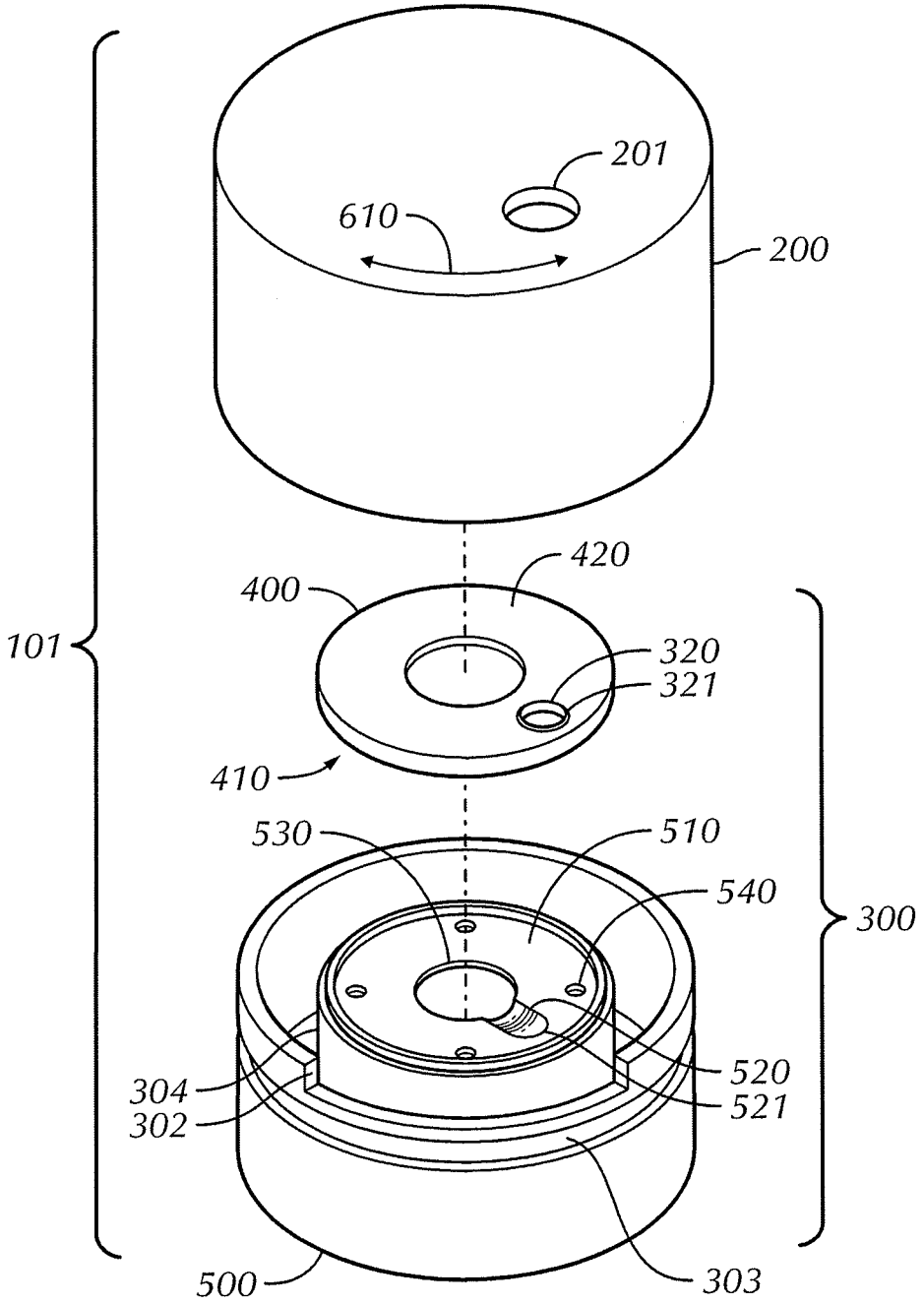
FIG. 3 is an exploded perspective view of an embodiment of the present caps that includes a top piece, a lower piece, and a middle piece.
Figure 4A:
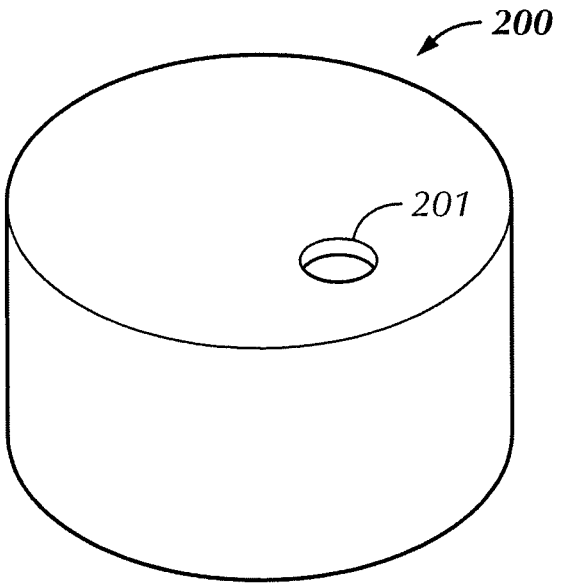
FIGS. 4A and 4B are perspective views of the top piece of the cap shown in FIG. 3.
Figure 4B:
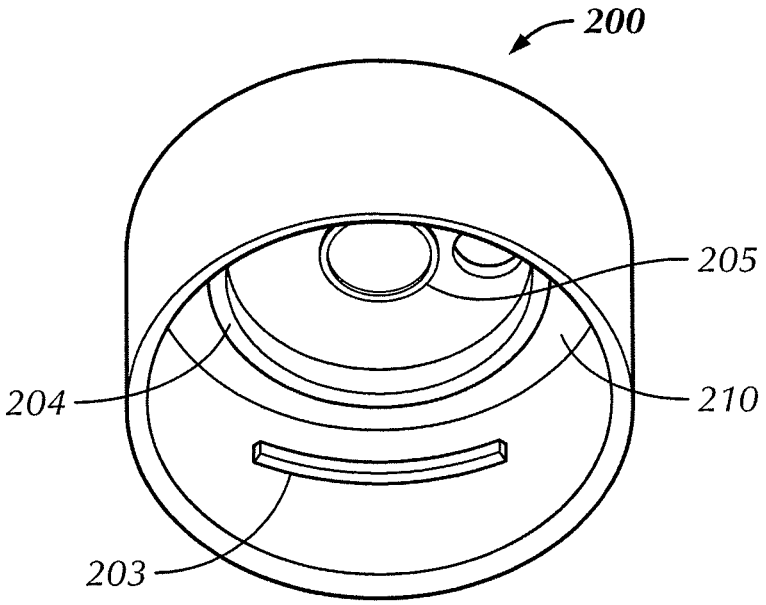
Figure 5:
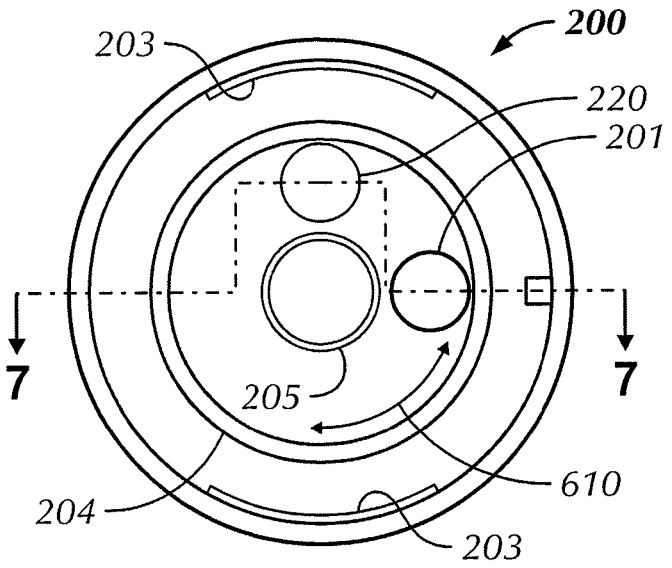
FIGS. 5-7 are bottom, top, and cross-sectional front views of the top piece of the cap shown in FIG. 3.
Figure 6:
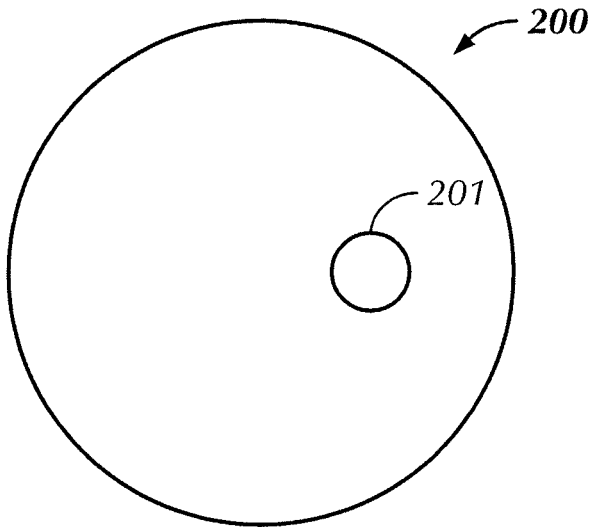
Figure 7:
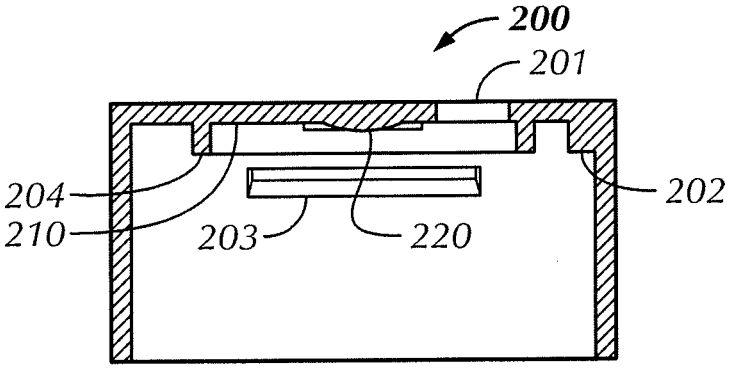
Figure 8:
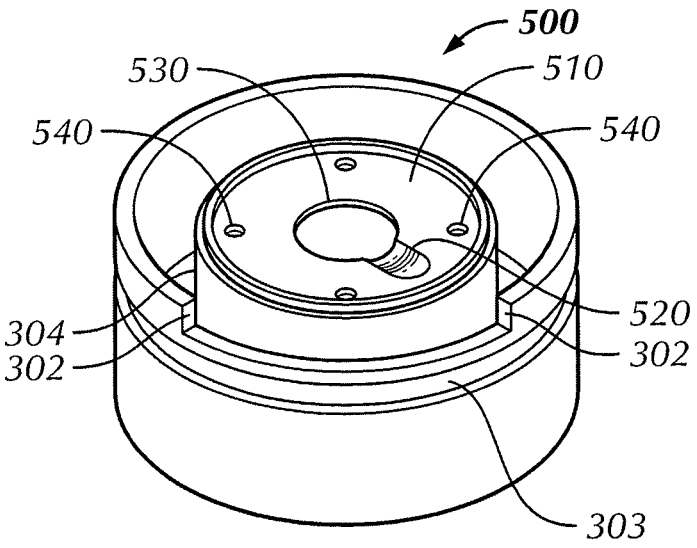
FIGS. 8-10 are perspective, bottom, top, and front views of the lower piece of the cap shown in FIG. 3.
Figure 9:
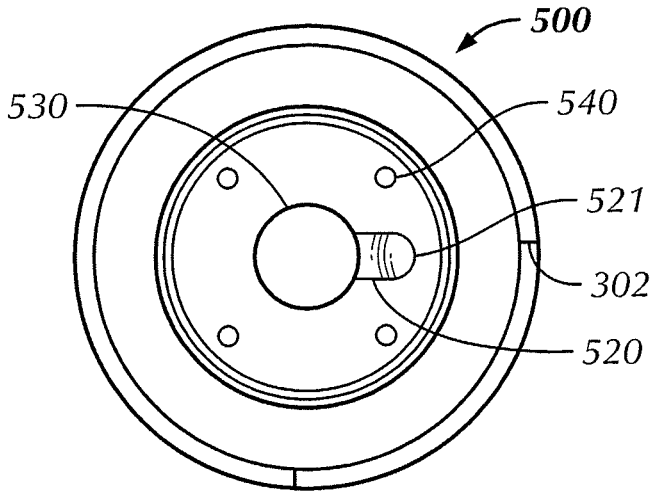
Figure 10:
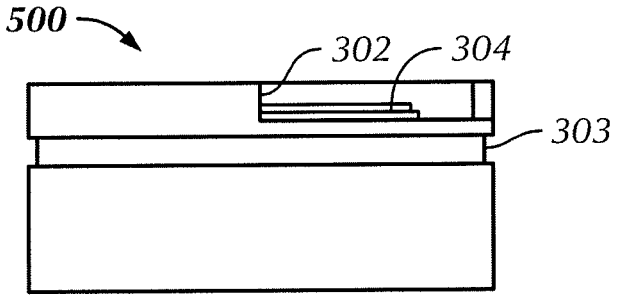

In some embodiments, cap 101 comprises top piece 200 and bottom piece 300 that are each unitary. In other embodiments, bottom piece 300 may be a bottom assembly that includes middle piece 400 and lower piece 500, as is depicted in FIGS. 2-3. Embodiments of these components may be plastic, or any of a variety of suitable materials that are well-known to those of ordinary skill. The material chosen may be translucent, transparent, semi-transparent, or opaque in different embodiments.

Top piece 200 includes dispensing opening 201, which may be positioned off-center and/or near the edge of top piece 200. When system 100 is in its open position, the product held within bottle 102 can exit cap 101 through dispensing opening 201. Bottle 102 may be coupled to the underside of bottom piece/assembly 300 in any suitable manner, including via a threaded engagement as shown in FIG. 2 or a snap-fit engagement. For a snap-fit engagement, the bottle and the cap can be provided with cooperating configurations well known to those of ordinary skill in the art for creating snap-fit engageable parts.

As shown in FIG. 1B, bottom piece/assembly 300 includes off-centered delivery opening 320 on bottom piece top surface 310 and, more specifically, on central projection 304. Off-centered delivery opening 320 may be bordered by raised lip 321. Bottom piece/assembly 300 may also include restriction element 302 and rail element 303, which is female in nature.

Figure 11A:
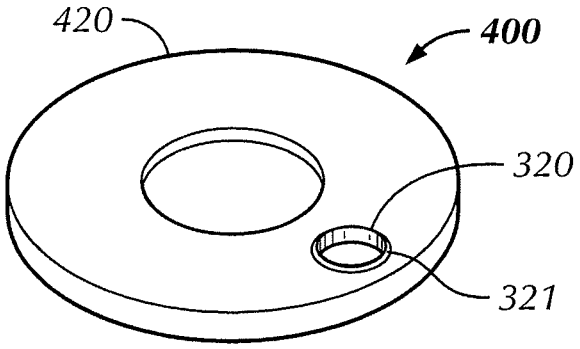
FIGS. 11A and 11B are perspective views of the middle piece of the cap shown in FIG. 3.
Figure 11B:
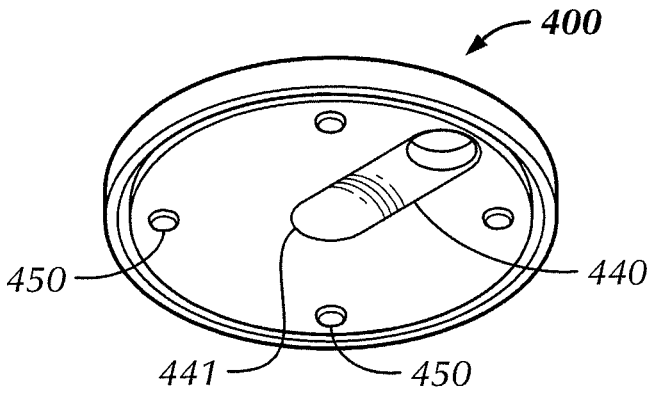
Figure 12:
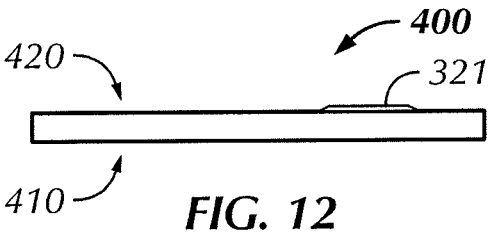
FIG. 12 is a front view of the middle piece of the cap shown in FIG. 3.

In embodiments having a bottom assembly that includes middle piece 400 and lower piece 500, off-centered delivery opening 320 may be part of middle piece top surface 420 of middle piece 400 as is shown in FIG. 3. Referring also to FIGS. 11A-B and 12, middle piece 400 may also include middle piece recessed region 440 that is in middle piece bottom surface 410. Middle piece recessed region 440 is coupled to off-centered delivery opening 320 and facilitates the flow of product to off-centered delivery opening 320.

Referring to FIGS. 3 and 8-10, some embodiments of lower piece 500 include lower piece top surface 510 having lower piece recessed region 520 coupled to centered delivery opening 530. Lower piece recessed region 520 facilitates the flow of product from centered delivery opening 530.

Referring to FIGS. 2-3, 8-10, 11A-B, and 12, bottom piece 300 may be a bottom assembly that includes middle piece 400 coupled to lower piece 500. This coupling may be accomplished in any suitable manner, including snap-fit engagement of coupling fasteners 450 and coupling fasteners 540. One of ordinary skill in the art will appreciate that many other coupling methods may be used (e.g., plastic welding for plastic embodiments, adhesives, mating threads).

In some embodiments, the coupling of middle piece 400 to lower piece 500 is such that middle piece recessed region 440 is aligned with lower piece recessed region 520 to form a channel that is coupled to both centered delivery opening 530 (via lower piece recessed region 520) and off-centered delivery opening 320 (via middle piece recessed region 440). In these embodiments, portion 441 of middle piece recessed region 440 may align with centered delivery opening 530, and portion 521 of lower piece recessed region 520 may align with off-centered delivery opening 320. This configuration facilitates a path for the flow of product from bottle 102 coupled to cap 101, through centered delivery opening 530, through the channel formed by middle piece recessed region 440 aligned with lower piece recessed region 520, and through off-centered delivery opening 320.

Some embodiments may not include lower piece recessed region 520. In these embodiments, the coupling of middle piece 400 to lower piece 500 is such that portion 441 of middle piece recessed region 440 aligns with centered delivery opening 530. Therefore, a path is provided for the flow of product from bottle 102 coupled to cap 101, through centered delivery opening 530, to portion 441 and through middle piece recessed region 440, and through off-centered delivery opening 320.

Some embodiments may not include middle piece recessed region 440. In these embodiments, the coupling of middle piece 400 to lower piece 500 is such that portion 521 of lower piece recessed region 520 aligns with off-centered delivery opening 320. Therefore, a path is provided for the flow of product from bottle 102 coupled to cap 101, through centered delivery opening 530, through lower piece recessed region 520 to portion 521, and through off-centered delivery opening 320.

Top piece 200 may include dispensing opening 201 and detent element 220 (extending from top piece bottom surface 210) that each may interact with off-centered delivery opening 320 of bottom piece/assembly 300, as depicted in FIGS. 1-7 and described in greater detail below. Top piece 200 also may include one or more male rail elements 203 that ride in rail element 303 of bottom piece/assembly 300 to allow top piece 200 and bottom piece/assembly 300 to rotate with respect to each other. Together, these rail elements also serve at least in part as the mechanism that couples the depicted embodiment of top piece 200 and bottom piece/assembly 300. In addition, top piece 200 may include stop element 202 that, together with restriction element 302 of bottom piece/assembly 300, controls the extent to which top piece 200 and bottom piece/assembly 300 can rotate with respect to each other.

Cap 101 may be configured such that the top and bottom pieces can be coupled to each other in any suitable manner, such as through a snap fit. One of ordinary skill in the art will appreciate that this may be achieved by tapering male rail element 203 such that the top piece 200 can fit over bottom piece/assembly 300 more easily than if the male rail elements had a rectangular profile.

Referring to FIGS. 4A-B and 5-7, embodiments of top piece 200 may include vertical collar 204 and center collar 205 to further align top piece top piece 200 over bottom piece/assembly 300 while allowing rotation of top piece 200 with respect to bottom piece/assembly 300. Vertical collar 204 may contact central projection 304 of bottom piece/assembly 300, and center collar 205 may contact features on bottom piece top surface (which may be features on middle piece top surface 420).

Referring also to FIGS. 1A-B and 2-3, cap 101 may be configured in a closed position or an open position by rotating top piece 200 relative to bottom piece/assembly 300, as depicted by arrow 610.

In the open position, dispensing opening 201 may be aligned with off-centered delivery opening 320, thereby allowing the flow of product from off-centered delivery opening 320 to exit dispensing opening 201. In the closed position, top piece 200 may be rotated to a configuration where detent element 220 is aligned with off-centered delivery opening 320. Detent element 220 extends from top piece bottom surface 210 such that it may contact off-centered delivery opening 320 when aligned in the closed position, thereby sealing off-centered delivery opening 320 and preventing the flow of product from cap 101.

Some embodiments of bottom piece/assembly 300 (which may include middle piece 400) include raised lip 321 that extends from bottom piece top surface 310 (which may be middle piece top surface 420) and borders (e.g., defines the perimeter of) off-centered delivery opening 320. Raised lip 321 may be configured to contact the edge of dispensing opening 201 when cap 101 is in the open position, thereby serving to prevent leakage of product flowing between off-centered delivery opening 320 and dispensing opening 201. This interference of raised lip 321 with dispensing opening 201 also serves to provide resistance against unintentional rotation away from the open position.

In the closed position, raised lip 321 of off-centered delivery opening 320 may serve to improve the seal of dispensing opening 201 provided by detent element 220. In some embodiments, dispensing opening 201, detent element 220, and raised lip 321 of off-centered delivery opening 320 may be configured to produce an audible sound (e.g., a "click") and/or tactile sensation to the user that indicates a particular position is reached, such as an open position or the closed position.

The present caps and container systems are not intended to be limited to the particular forms disclosed. Rather, they include all modifications, equivalents, and alternatives falling within the scope of the claims. For example, while the dispensing element of the top piece of the cap depicted in the figures is shown as a single opening, in other embodiments the dispensing element comprises multiple (e.g., 2 or more) smaller openings clustered together.

The claims are not to be interpreted as including means-plus- or step-plus-function limitations, unless such a limitation is explicitly recited in a given claim using the phrase(s) "means for" or "step for," respectively.

The invention claimed is:

1. A cap comprising:

a bottom assembly including:

a lower piece having a lower piece top surface that includes a centered delivery opening; and a middle piece coupled to the lower piece, the middle piece including a middle piece bottom surface, a middle piece top surface, an off-centered delivery opening through the middle piece bottom surface and through the middle piece top surface, and a middle piece recessed region that is in the middle piece bottom surface and coupled to the off-centered delivery opening;

where the middle piece bottom surface is adjacent to the lower piece top surface, and a portion of the middle piece recessed region is substantially aligned with the centered delivery opening; and a top piece having a top piece bottom surface that includes a dispensing opening and a detent element that is unitary with the top piece, the top piece being rotatably coupled to the bottom assembly such that:

the top piece bottom surface is adjacent to the middle piece top surface;

the dispensing opening is substantially aligned with the off-centered delivery opening when the cap is in an open position; and the detent element is substantially aligned with the off-centered delivery opening when the cap is in a closed position where the cap is configured for fluid to be dispensed through the centered delivery opening, the off-centered delivery opening, and the dispensing opening when the cap is in an open position.

2. The cap of claim 1, where:

the lower piece top surface further includes a lower piece recessed region coupled to the centered delivery opening; and the off-centered delivery opening is substantially aligned with a portion of the lower piece recessed region.

3. The cap of claim 2, where the middle piece further includes a raised lip that extends from the middle piece top surface and borders the off-centered delivery opening, and where the raised lip is configured to contact an edge of the dispensing opening when the cap is in an open position.

4. The cap of claim 2, where the dispensing opening and the detent element are separated by approximately 90 degrees with respect to a center of the top piece bottom surface.

5. The cap of claim 2, where the top piece and bottom assembly are configured such that relative rotation between them is restricted to approximately 90 degrees.

6. The cap of claim 2, where the bottom assembly is configured to be coupled to a container.

7. The cap of claim 6, where the bottom assembly and the top piece are configured with mating rail elements that facilitate their rotation relative to each other.

8. The cap of claim 6, where the top piece and bottom assembly are configured to direct a fluid through a path that comprises the centered delivery opening, the lower piece recessed region and the middle piece recessed region, the off-centered delivery opening, and the dispensing opening.

9. The cap of claim 1, where the bottom assembly is configured to be coupled to a container.

10. The cap of claim 6, where the top piece and bottom assembly are configured to direct a fluid through a path that comprises the centered delivery opening, the middle piece recessed region, the off-centered delivery opening, and the dispensing opening.

11. A container system comprising a bottle configured to hold a fluid, and a cap according to claim 1 coupled to the bottle.

12. A container system comprising a bottle configured to hold a fluid, and a cap according to claim 2 coupled to the bottle.

13. A cap comprising:

a bottom assembly including:

a lower piece having a lower piece top surface that includes a centered delivery opening, and a lower piece recessed region coupled to and extending radially outward from the centered delivery opening; and a middle piece coupled to the lower piece, the middle piece including a middle piece bottom surface, a middle piece top surface, and an off-centered delivery opening through the middle piece bottom surface and through the middle piece top surface;

where the middle piece bottom surface is adjacent to the lower piece top surface, and the off-centered delivery opening is substantially aligned with a portion of the lower piece recessed region; and a top piece having a top piece bottom surface that includes a dispensing opening and a detent element, the top piece being rotatably coupled to the bottom assembly such that:

the top piece bottom surface is adjacent to the middle piece top surface;

the dispensing opening is substantially aligned with the off-centered delivery opening when the cap is in an open position; and the detent element is substantially aligned with the off-centered delivery opening when the cap is in an closed position;

where the cap is configured for fluid to be dispensed through the centered delivery opening and the dispensing opening when the cap is in an open position.

14. The cap of claim 13, where the middle piece further includes a raised lip that extends from the middle piece top surface and borders the off-centered delivery opening, and where the raised lip is configured to contact an edge of the dispensing opening when the cap is in an open position.

15. The cap of claim 13, where the dispensing opening and the detent element are separated by approximately 90 degrees with respect to a center of the top piece bottom surface.

16. The cap of claim 13, where the top piece and bottom assembly are configured such that relative rotation between them is restricted to approximately 90 degrees.

17. The cap of claim 13, where the bottom assembly is configured to be coupled to a container.

18. The cap of claim 17, where the bottom assembly and the top piece are configured with mating rail elements that facilitate their rotation relative to each other.

19. The cap of claim 17, where the top piece and bottom assembly are configured to direct a fluid through a path that comprises the centered delivery opening, the lower piece recessed region, the off-centered delivery opening, and the dispensing opening.

20. A container system comprising a bottle configured to hold a fluid, and a cap according to claim 13 coupled to the bottle.

* * * * *

UNITED STATES PATENT AND TRADEMARK OFFICE

CERTIFICATE OF CORRECTION

PATENT NO. : 9,181,005 B2
APPLICATION NO. : 12/358408
DATED : November 10, 2015
INVENTOR(S) : DeMarco It is certified that error appears in the above-identified patent and that said Letters Patent is hereby corrected as shown below:

In the claims

Claim 10 column 7, line 37, delete "6" and insert --9-- therefor.

Signed and Sealed this
Twenty-sixth Day of April, 2016

Michelle K. Lee

Michelle K. Lee
*Director of the United States Patent and Trademark Office*